United States Patent [19]

Matsui et al.

[11] Patent Number: 4,619,416

[45] Date of Patent: Oct. 28, 1986

[54] YARN END FINDING APPARATUS

[75] Inventors: Isamu Matsui, Kyoto; Hiroshi Uchida, Ohmihachiman; Noboru Sekitani, Ohtsu; Hirokazu Okumura, Kyoto, all of Japan

[73] Assignee: Murata Kikai Kabushiki Kaisha, Kyoto, Japan

[21] Appl. No.: 631,304

[22] Filed: Jul. 16, 1984

[30] Foreign Application Priority Data

Jul. 19, 1983 [JP] Japan ..... 58-1315241

[51] Int. Cl.[4] ..... B65H 54/20; B65H 65/00; B65H 67/02

[52] U.S. Cl. ..... 242/35.5 R; 242/18 EW; 242/35.5 A; 242/35.6 E

[58] Field of Search ..... 242/35.5 R, 35.6 R, 242/35.6 E, 35.5 A, 18 R, 18 EW

[56] References Cited

U.S. PATENT DOCUMENTS

| | | | |
|---|---|---|---|
| 3,279,712 | 10/1966 | Furst | 242/35.5 R |
| 3,295,775 | 1/1967 | Raasch et al. | 242/35.5 R |
| 3,471,101 | 10/1969 | Moyer et al. | 242/35.6 R |
| 3,480,216 | 11/1969 | Iannucci et al. | 242/35.6 R |
| 3,544,018 | 12/1970 | Stoppard et al. | 242/35.6 R |
| 3,608,843 | 9/1971 | Siedlich | 242/35.6 E |
| 3,708,134 | 1/1973 | Stoppard | 242/35.6 R X |
| 3,727,852 | 4/1973 | Nelson et al. | 242/35.6 R |
| 3,850,377 | 11/1974 | Pitts et al. | 242/35.6 R X |
| 4,463,909 | 8/1984 | Kiriake et al. | 242/35.5 A |

*Primary Examiner*—Stanley N. Gilreath

*Attorney, Agent, or Firm*—Spensley Horn Jubas & Lubitz

[57] ABSTRACT

A yarn end finding apparatus having a vertically movable hollow member which can be raised to allow positioning of a bobbin thereunder and then lowered onto the bobbin. The hollow member includes a device for releasing the end of the yarn from the bobbin. A vertical flow of air through the hollow member directs the released yarn away from the bobbin past a yarn clamping device and a blade which cuts the yarn at a predetermined distance from the clamping device. A reverse flow of air directs the remaining length of yarn into the hollow bobbin core for subsequent processing.

14 Claims, 19 Drawing Figures

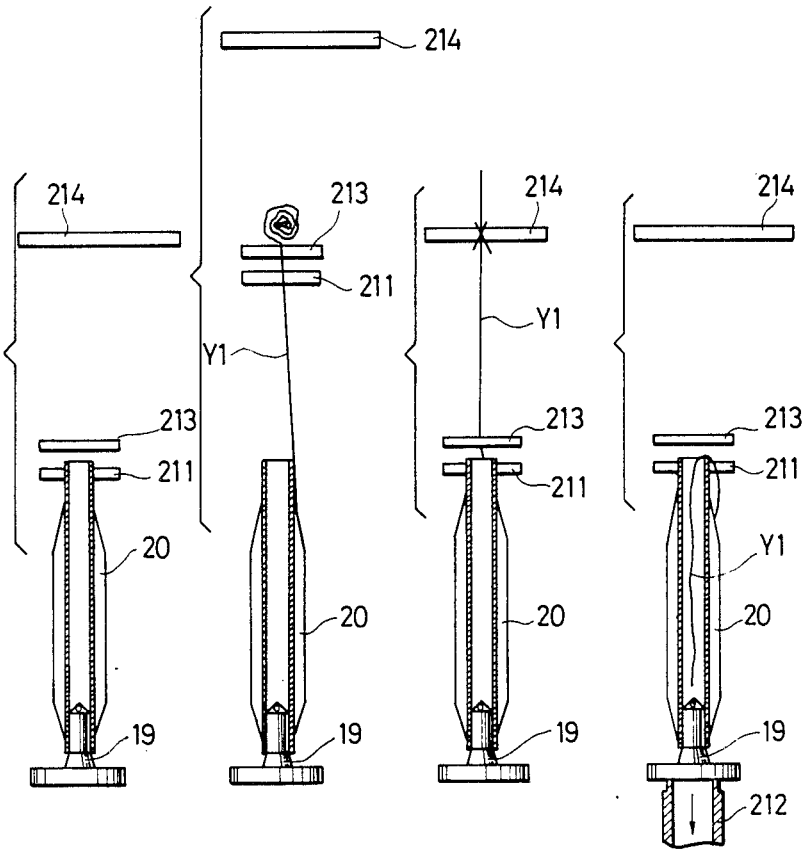
(F) FIG. 15 (L) FIG. 16 (T) FIG. 17 (S) FIG. 18

YARN END FINDING APPARATUS

BACKGROUND OF THE INVENTION

1. Field of the Invention

This invention relates to a yarn end finding apparatus for a spinning bobbin supplied to an automatic winder.

2. Prior Art

In an automatic winder having a number of winding units arranged in an juxtaposed relationship, generally each of such winding units has a spinning bobbin magazine which stocks a plurality of spinning bobbins therein and delivers one of them in response to a spinning bobbin demanding instruction of the winding unit to supply it onto a spinning bobbin supporting peg of the unit. Generally, spinning bobbins are supplied to such spinning bobbin magazines either suitably by an operator or automatically by means of a travelling car.

The present applicant already proposed a spinning bobbin supplying system which is different from such a spinning bobbin supplying system as described above. In particular, the applicant proposed a system which has no magazine provided for winding units of a winder and includes a spinning bobbin supplying path which is arranged to extend along the winding units such that carriers each having a spinning bobbin independently fitted thereon may be transported on the spinning bobbin supplying path and each supplied in integral relationship with the spinning bobbin to a winding position of each winding unit.

SUMMARY OF THE INVENTION

An object of the present invention is to provide a yarn end finding apparatus for such a spinning bobbin supplying system as described just above which finds and picks up an end of a yarn on a spinning bobbin and inserts the yarn end of a particular length into a take-up tube of the spinning bobbin.

Particularly a yarn end finding apparatus of the present invention is suitable for finding a yarn end of a spinning bobbin which has a bunch wind position at the top end thereof, that is, a spinning bobbin which has a top bunch, and also suitable for finding a yarn end of a spinning bobbin which has an end of a yarn sticking to a surface of a layer of the yarn or a similar spinning bobbin. According to the present invention, a yarn end finding apparatus comprises a vertically movable member mounted for vertical movement toward and away from a spinning bobbin which is positioned at a fixed position, the vertically movable member having thereon a means for releasing a top bunch of the spinning bobbin, another means for sucking and clamping the yarn end thus released, and a further means for cutting the yarn end thus drawn from the spinning bobbin at a position for a particular length, and a suction pipe located below a carrier at the fixed position for inserting the yarn end thus cut into a take-up tube of the spinning bobbin. Accordingly, yarn end finding of a top bunch can be performed with a spinning bobbin held fitted on a carrier and by an up and down motion of the vertically movable member, resulting in a compact size of the entire apparatus.

In addition, if a spinning bobbin is transported to a winder while a yarn end found and picked up is held suspended in a take-up tube of the spinning bobbin, then blowing up of the yarn end will assure gripping of the yarn end on the spinning bobbin for yarn splicing and subsequent introduction of the same into a knotter.

BRIEF DESCRIPTION OF THE DRAWINGS

FIGS. 15–18 are schemetic views showing relative positions of individual yarn processing devices of a vertically movable member and an end of a yarn in particular steps of the process of FIG. 14.

DETAILED DESCRIPTION OF THE INVENTION

An embodiment of the present invention will now be described in detail with reference to the accompanying drawings.

Figure 1:
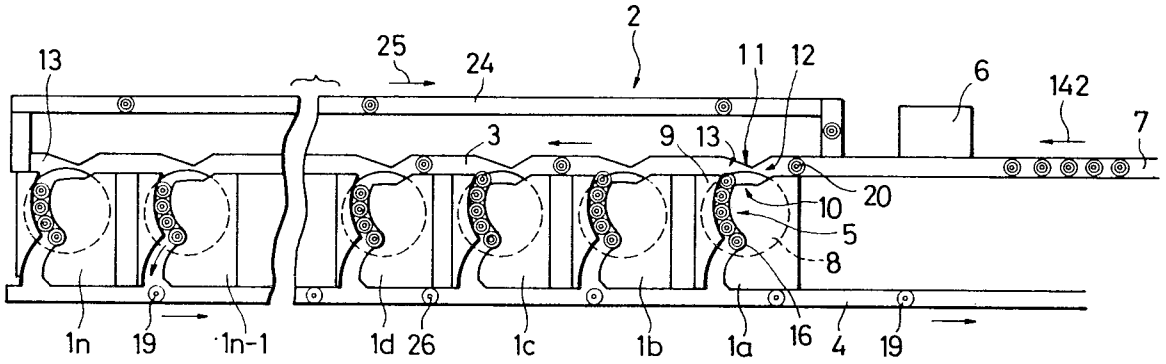
FIG. 1 is a schematic view showing an example of a system for supplying spinning bobbins to an automatic winder.

FIG. 1 shows a spinning bobbin supplying system for an automatic winder to which an apparatus according the invention is applied.

In particular, an automatic winder 2 has a number of winding units 1*a* to 1*n* arranged in a row, and a spinning bobbin supplying path 3 extends along one side of the row of the winding units 1*a* to 1*n* while a bobbin returning path 4 for returning an empty bobbin or a bobbin with a remaining yarn thereon extends along the other side of the row of the winding units 1*a* to 1*n*. Each of the spinning bobbin supplying path 3 and the bobbin returning path 4 may be constituted, for example, from a belt conveyor. A carrier path 5 extends through each winding unit between the transporting paths 3 and 4, and a rewinding position is defined at one location of the carrier path 5. A yarn end finding apparatus 6 for a spinning bobbin is disposed adjacent one end of the spinning supplying path 3 adjacent the winder, and on this apparatus 6, a top bunch of a spinning bobbin which has been fed thereto on a conveyor 7 from, for example, a fine spinning frame or a spinning bobbin supplying position is released and an end of a yarn of a particular length is inserted into and suspended within a take-up tube of the spinning bobbin.

Figure 2:
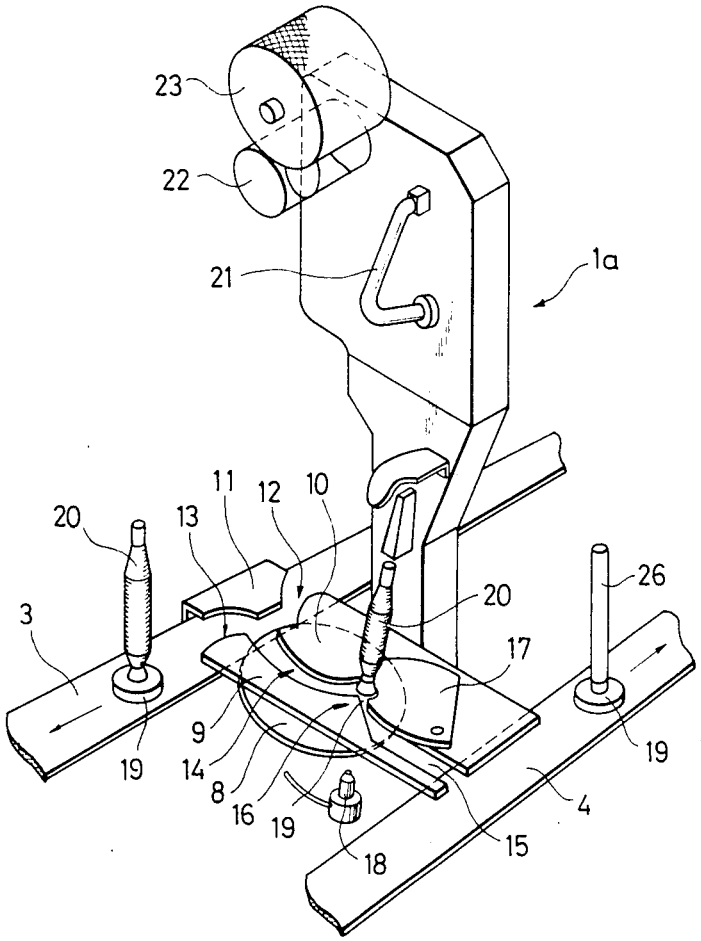
FIG. 2 is a perspective view, in diagrammatic representation, illustrating an example of a winding unit which is applied to the system of FIG. 1.

FIG. 2 illustrates an example of such winding units 1*a* to 1*n* which includes a movable guide disk 8 and a pair of fixed guide plates 9 and 10 which cooperate to take in a spinning bobbin from the supplying path 3. The movable guide disk 8 is mounted for rotation around an axis which is rather inclined such that a portion of the disk 8 adjacent the spinning bobbin supplying path 3 is located higher than another portion adjacent the empty bobbin transporting path 4. The guide plates 9, 10 are securely mounted in a particular spaced relationship above the rotatable disk 8, and a spinning bobbin inlet port 12 is defined by the guide plate 10 and another guide plate 11 while a surplus spinning bobbin outlet port 13 is defined by the guide plates 9 and 11. A spinning bobbin stand-by guideway 14 and a bobbin discharging guideway 15 are defined by the guide plates 9 and 10. The aforementioned rewinding position 16 is provided by a joining point between the spinning bobbin stand-by guideway 14 and the bobbin discharging guideway 15. A lever 17 is provided for discharging an empty bobbin 26 or a bobbin with a yarn remaining thereon. Disposed below a carrier at the rewinding position is a compressed air injecting nozzle 18 which communicates with a compressed air supply source not shown by way of a conduit. Thus, compressed air injected from the injection nozzle 18 is injected into a take-up tube of a spinning bobbin 20 from a spacing within a peg of a carrier 19 through an arcuate slit not shown formed in the rotatable disk 8 thereby to blow up an end of a yarn suspended within and from the top end of the take-up tube to a position above and outside the take-up tube. Then, a relay pipe 21 which is located at a stand-by position above the spinning bobbin at the rewinding position 16 sucks and holds the yarn end thus blown up and pivots upwardly to introduce the yarn end into a knotter at which the yarn end on the spinning bobbin side is spliced to an end of another yarn on a package side in order to start rewinding of the yarn. Reference numeral 22 designates a traverse drum, and 23 a winding package.

In particular, the yarn end finding apparatus 6 finds and picks up an end of a yarn for yarn splicing from a spinning bobbin which has been fed thereto on the spinning bobbin transporting path 7. Thus, the spinning bobbin is then fed to the spinning bobbin transporting path 3 of the winder while it is held fitted on a carrier with the yarn end inserted in the take-up tube of the spinning bobbin. The spinning bobbin is then fed on the spinning bobbin transporting path 3 until the carrier 19 thereof is abutted against the guide plates 9, 10 and 11 of the winding unit 1*a* and is transferred onto the rotatable disk 8. As a result, the spinning bobbin is admitted into the stand-by guideway 14 by way of the spinning bobbin inlet port 12 and comes to the rewinding position 16. In this manner, succeeding spinning bobbins will be admitted one after another into the spinning bobbin stand-by guideway 14 until the stand-by guideway 14 is filled with a predetermined number of spinning bobbins. Accordingly, spinning bobbins which are fed to the winding unit 1*a* after they will be prevented from entering the stand-by guideway 14 and hence they will be caused to move to the next winding unit 1*b* by way of the surplus spinning bobbin outlet port 13.

In this manner, carriers having spinning bobbins fitted thereon sucessively fill the stand-by guideways of each winding unit, beginning with the winding unit 1*a*, which is nearest to the yarn end finding apparatus 6, and ending with the winding unit 1*n*, which is farthest from the yarn end finding apparatus 6. However, if space becomes available in previously filled guideway before the guidways of all winding units are filled, then such space will be filled with bobbins, beginning with the winding unit nearest to the winding unit 1*a*, before the remaining guideways are filled with bobbins. Spinning bobbins which have not been admitted by any of the winding units 1*a* to 1*n* will, after leaving the surplus spinning bobbin outlet port 13 of the last winding unit 1*n*, enter a circulating path 24 along which they will be fed in a direction of an arrow mark 25 until they are supplied into the spinning bobbin transporting path 3 again.

The yarn end finding apparatus for a spinning bobbin will be described below.

Figure 3:
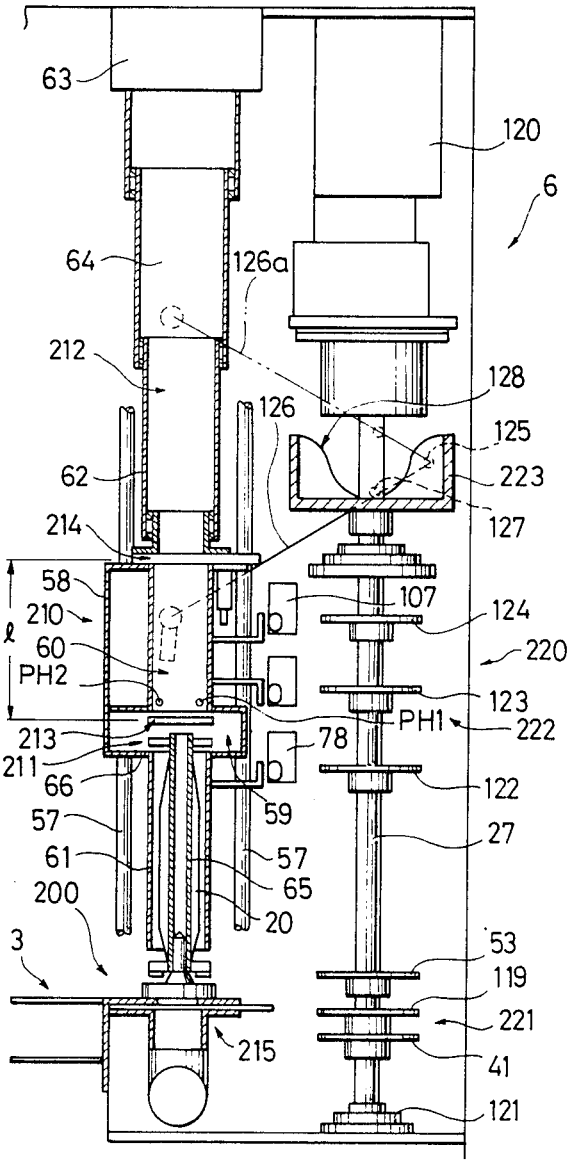
FIG. 3 is a front elevational view, in diagrammatic representation, showing an embodiment of a yarn end finding apparatus according to the present invention.

FIG. 3 shows general construction of a yarn end finding apparatus. In particular, the yarn end finding apparatus 6 is disposed adjacent one side of the spinning bobbin transporting path 3 and includes a spinning bobbin taking in and discharging device 200 for taking in a spinning bobbin from the transporting path 3 to a particular fixed position, a yarn end processing device 210 for releasing, cutting and inserting an end of a yarn of the spinning bobbin thus positioned, and a driving section 220 for driving the processing device 210. The yarn end processing device 210 includes a top bunch releasing mechanism 211, a first yarn end sucking mechanism 212, a clamp mechanism 213 for clamping a yarn end thus released to further release the same by a suitable length, a yarn cutting mechanism 214 for cutting the yarn end thus released into a segment of a particular fixed length, a second yarn end sucking mechanism 215 for inserting the yarn segment thus cut into a take-up tube of a spinning bobbin.

The driving section 220 includes a first group of cams 221 secured to a cam shaft 27 for driving a spinning bobbin taking in device, a second group of cams 222 for driving the yarn end processing device 210, and a third cam 223 for lifting the yarn end processing device 210.

Such components as described above will be described individually in detail.

(A) Spinning Bobbin Taking in and Discharging Device

Figure 4A:
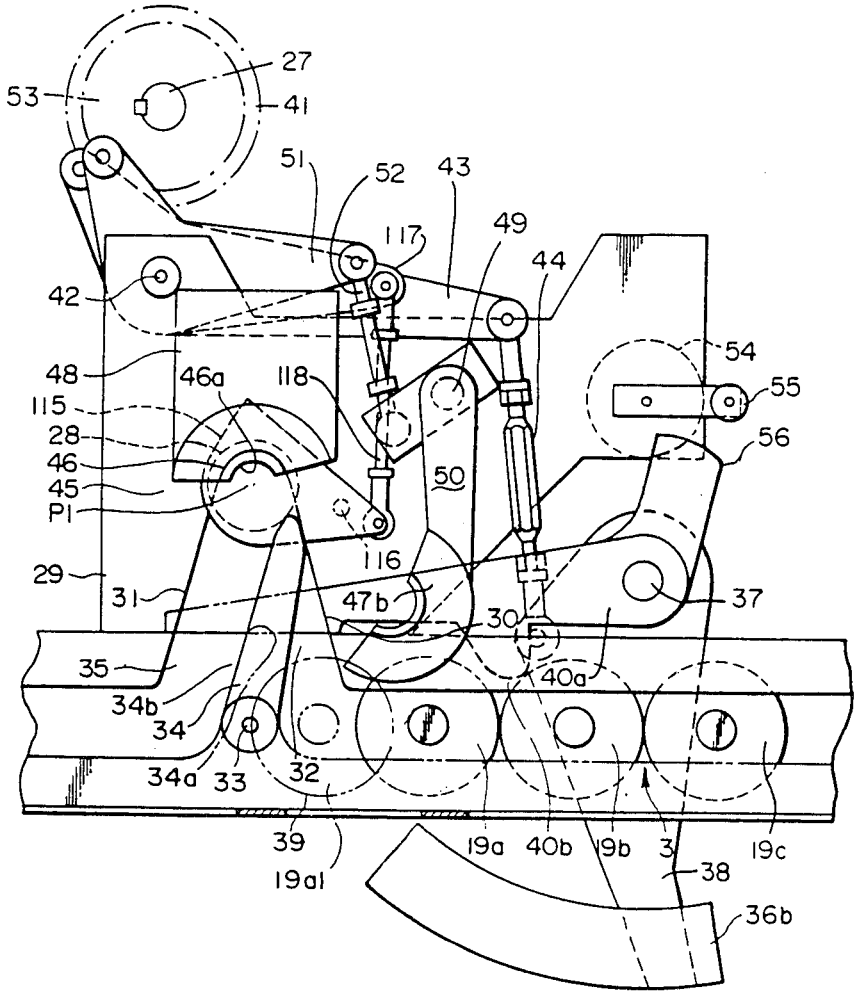
FIGS. 4*a* and 4*b* are plan views showing a device for taking in a carrier to a yarn end finding position and for discharging the same therefrom.
Figure 4B:
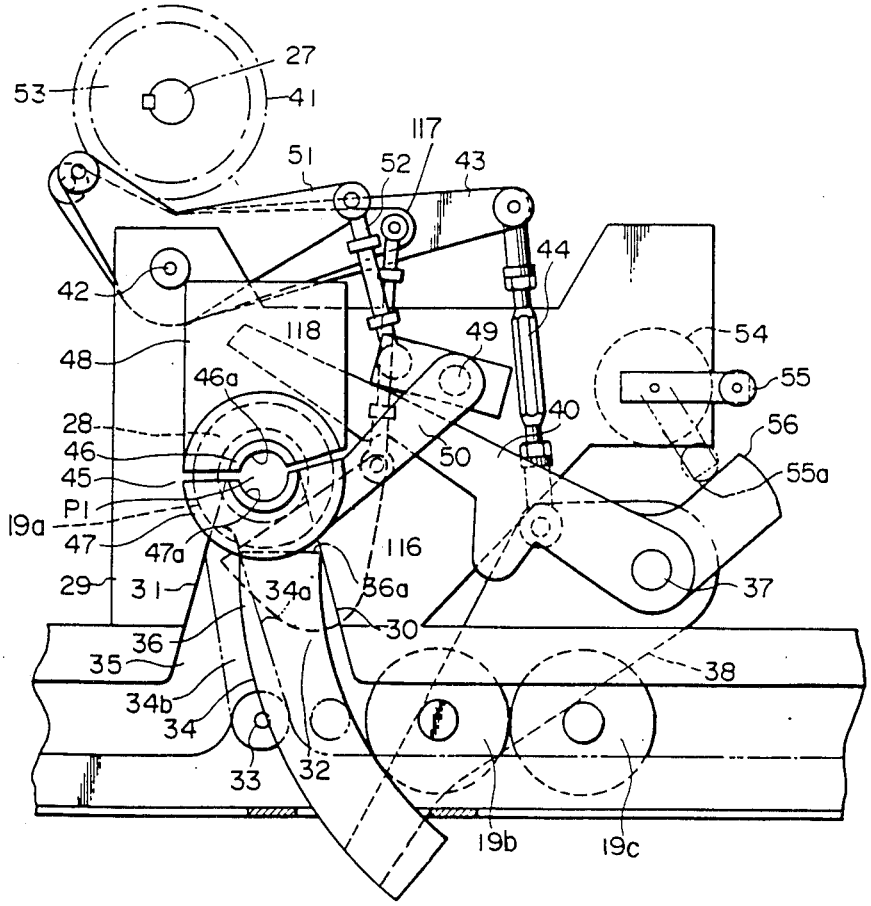
Figure 5:
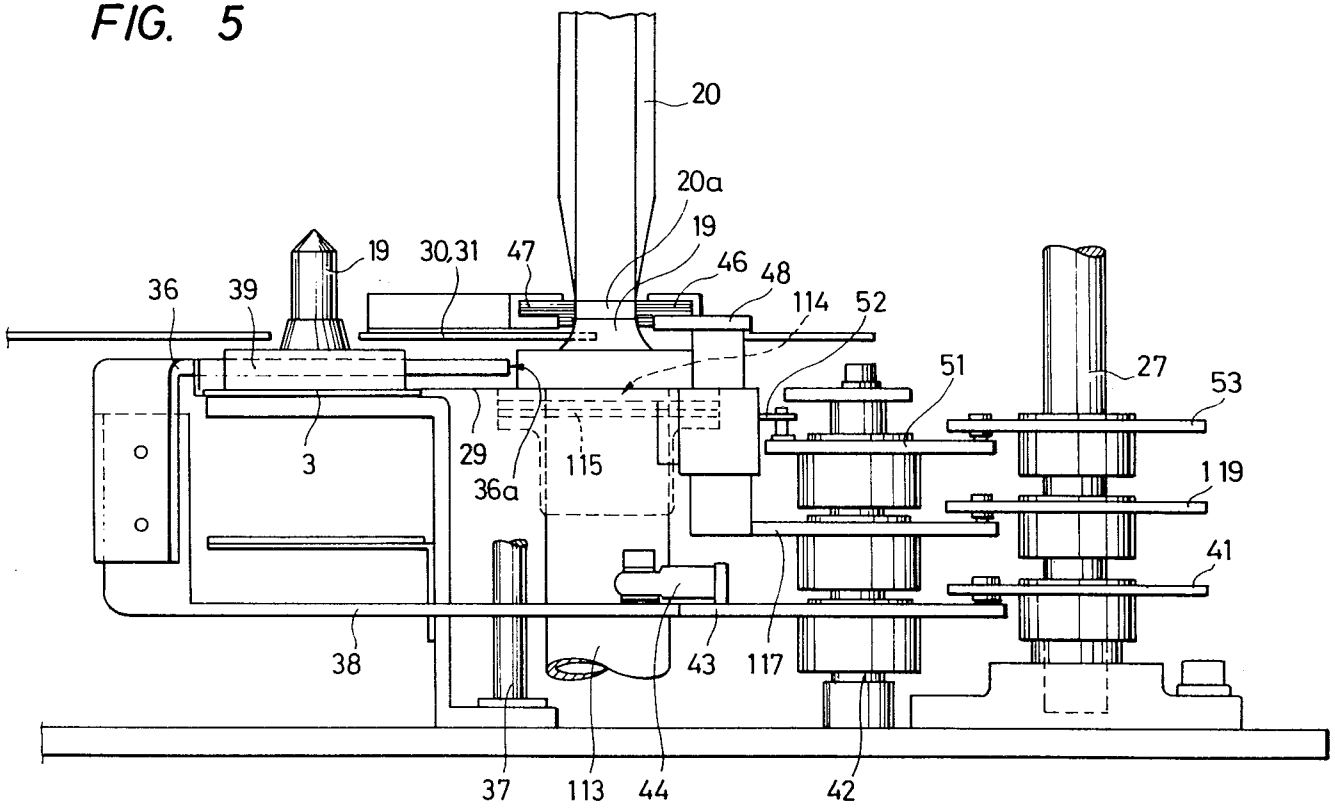
FIG. 5 is a side elevational view of the device of FIG. 4*b;*

Referring to FIGS. 4*a*, 4*b* and 5, a pipe opening 28 of the second sucking mechanism is located adjacent one side of the spinning bobbin transporting path 3 and defines a yarn end finding position P1. Disposed between the transporting path 3 and the yarn end finding position P1 are a bottom plate 29 and a pair of side plates 30 and 31. A spinning bobbin taking in passage 32 is defined by the side plate 30 and a side edge 34*a* of a rockable lever 34 which is mounted for rocking motion about a shaft 33 while a spinning bobbin discharging passage 35 is defined by the other side plate 31 and the opposite side edge 34*b* of the rockable lever 34. The rockable lever 34 is normally urged by means of a spring (now shown) to the position illustrated in FIG. 4*a*.

As shown in FIG. 4*b*, forcing lever 36 for pulling a carrier 19*a*l on the transporting path 3 into the yarn end finding position P1 is mounted for pivotal motion about a fixed shaft 37. In particular, the forcing lever 36 having an arcuate upper face is securely mounted on a lever 38 which is supported for pivotal motion on the shaft 37. Thus, the lever 38 can pivot across the transporting path 3 to a position in which an end 36*a* thereof is abutted against an outer circumferential face of a base disk 39 of the carrier 19*a*l. A normal stand-by position of the lever 36 only is shown in FIG. 4*a*.

The shaft 37 for the forcing lever 36 has another discharging lever 40 supported thereon so that both levers 36 and 40 can pivotally move in integral relationship. The discharging lever 40 is movable between a position shown in FIG. 4*a* the position shown in FIG. 4*b*. The lever normally stands in the position shown in FIG. 4*a*. In this position, a projection 40*b* formed at a mid portion of the lever 40 extends above the transporting path 3 so as to be abutted by and stop a succeeding next carrier 19*b*, while allowing only a carrier 19*a* at an advanced position relative to the projection 40*b* to move on the transporting path 3 to a position adjacent the taking in passage 32. The forcing lever 36 and the discharging lever 40 are driven by way of a rod 44 connected to a portion of the forcing lever 36 and also to a cam lever 43 which is pivotally moved around a shaft 42 by a cam plate 41.

Further, a clamp device 45 for clamping a lower end of a spinning bobbin on a carrier thus pushed into the yarn end finding position P1 is constituted from a fixed clamping member 46 and a movable clamping member 47. In particular, the fixed clamping member 46 is securely mounted on a bracket 48 and has an arcuate face 46*a* which is pressed against an outer periphery of a take-up tube of the carrier while the movable clamping member 47 is secured to a lever 50 mounted for pivotal motion on a shaft 49 and has an arcuate face 47*a* which is pressed against the outer periphery of the take-up tube. Each of the clamping members may be constituted from a part which includes, for example, a plurality of elastic elements and iron plates layered in alternate relationship so as to prevent slipping of a spinning bobbin clamped thereby. A rod 52 is interconnected between the lever 50 for the movable clamping member 47 and a cam lever 51 so that rotation of a cam plate 53 may pivotally move the movable clamping member 47 between the position shown in FIG. 4*b* and the position shown in FIG. 4*a* to clamp or release a spinning bobbin.

As illustrated in FIGS. 4*a* and 4*b* a stopper 55 which is pivoted by a rotary solenoid 54 is mounted for engagement with a rear end of the discharging lever 40 and is normally positioned as shown in FIG. 4*a*, but if yarn end finding of a spinning bobbin at the yarn end finding position has resulted in failure, then by operation of a yarn end detecting sensor, the stopper 55 will move to the two dots and dash line position 55*a* (FIG. 4*b*) to prevent discharging of the spinning bobbin, thereby assuring another yarn end finding operation to be performed for the spinning bobbin.

(B) Yarn End Processing Position

Referring again to FIG. 3, a vertically movable member 58 is mounted for up and down movement along a pair of uprightly erected guide rods 57. The vertically movable member 58 has a first processing chamber 59 circumferentially surrounded by a side wall, and a second yarn processing chamber 60. Below the first processing chamber 59, a cylindrical member 61 for covering around a layer of a yarn of a spinning bobbin 20 is secured to the vertically movable member 58 and communicates with the first processing chamber 59. Adjacent an opening at an upper end of the second processing chamber 60, a lower end of an expandable movable pipe 62 is secured. The movable pipe 62 is connected to a blower 63 by way of a pipe 64.

The top bunch releasing mechanism 211 is located at a lower position within the first processing chamber 59, and the yarn end clamp mechanism 213 is located at an upper position within the first processing chamber 59. The second processing chamber 60 contains the yarn cutting device 214 which has a movable edge that can pivot across the second processing chamber 60. It is to be noted that a distance (l) between the yarn end clamp position and the yarn cutting position is prescribed in connection with the length of an end segment of a yarn inserted and suspended in a take-up tube 65.

Figure 6:
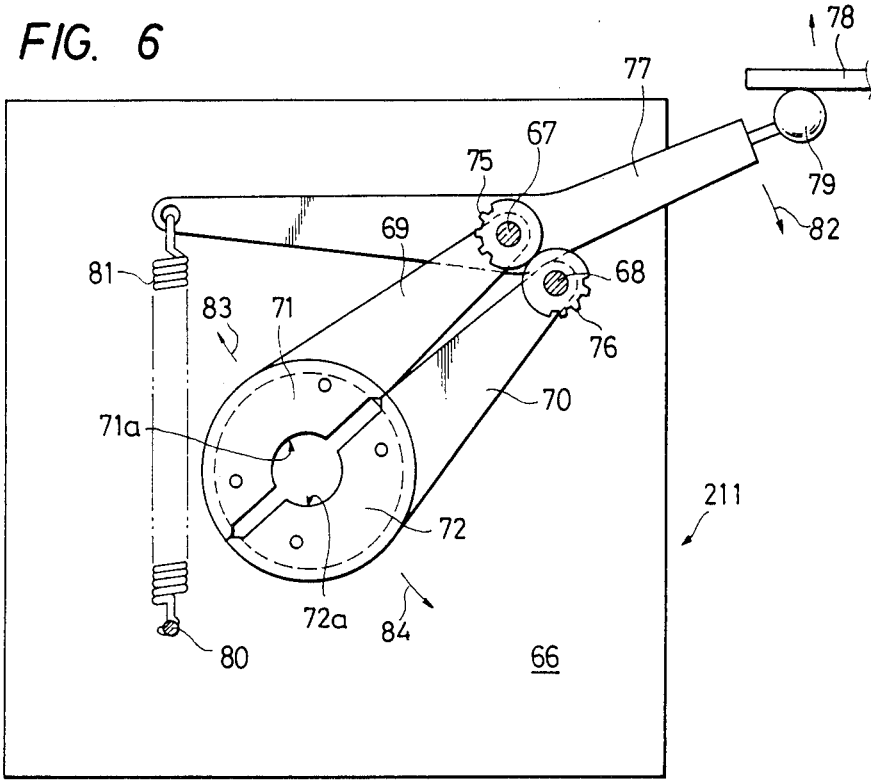
FIG. 6 is a plan view of a top bunch releasing device.
Figure 7:
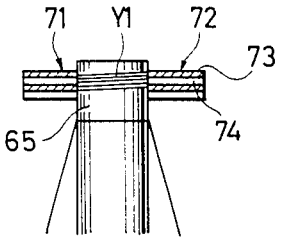
FIG. 7 is a front elevational view showing releasing members clamping a top bunch therebetween.

FIGS. 6 and 7 illustrate the top bunch releasing device 211. The top bunch releasing device 211 includes a pair of yarn end releasing members 71 and 72 adapted to be pressed against an upper end of a spinning bobbin. The yarn end releasing members 71 and 72 are securely mounted on a pair of levers 69 and 70, respectively, which are in turn secured to a pair of shafts 67 and 68, respectively, which are uprightly erected on a bottom wall 66 of the first processing chamber 59 of the vertically movable member.

The releasing members 71 and 72 have arcuate faces 71*a* and 72*a*, respectively, adapted to be pressed against an outer periphery of a take-up tube and may each be a part which includes elastic members 73 and iron plates 74 layered in alternate relationship. Further, a pair of gears 75 and 76 are secured to the shafts 67 and 68, respectively, and are held in mesh with each other. An operating lever 77 is secured to the shaft 67 and has a roller 79 supported at an end thereof. The roller 79 is abutted against an operating plate 78 which will be described hereinafter. Connected at the opposite end of the operating lever 77 is an end of a spring 81 which is connected at the other end thereof to a pin 80 secured to the bottom plate 66.

Accordingly, if the operating lever 77 is pushed in a direction of an arrow mark 82 by the operating plate 78, the releasing member 71 is moved open in a direction of another arrow mark 83 around the shaft 67. At the same time, the other releasing member 72 is moved in a direction of a further arrow mark 84 by way of the gears 75 and 76 to a stand-by position for pressing and clamping an upper end portion of a take-up tube. After then, if the operating plate 78 is moved in the opposite direction to separate from the roller 79, the two releasing members 71 and 72 are now moved in the opposite closing direction by means of the spring 81 so that they press against and clamp the spinning bobbin at a position of a top bunch Y1 as shown in FIG. 7.

Figure 8:
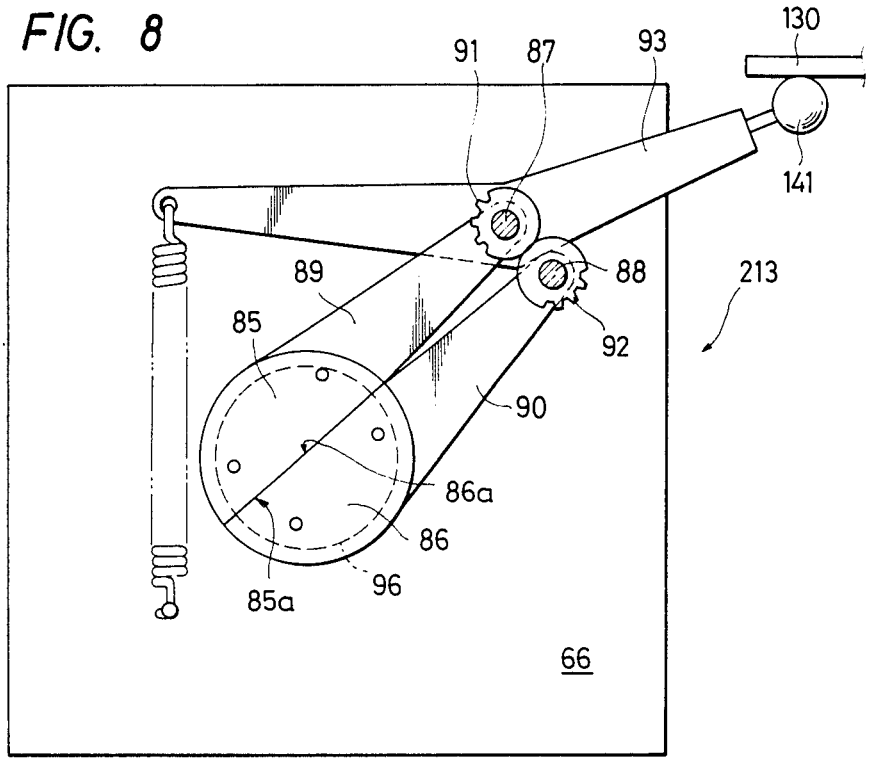
FIG. 8 is a plan view of a yarn end clamp device.
Figure 9:
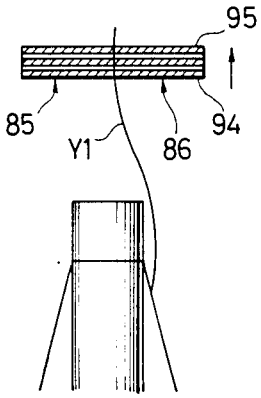
FIG. 9 is a front elevational view showing the yarn end clamp device clamping an end of a yarn therein.

FIGS. 8 and 9 show the yarn end clamp device 213. In particular, the yarn end clamp device 213 has a substantially same construction as the top bunch releasing device 211 except that clamp members 85 and 86 are secured in place of the releasing members 71 and 72. The clamp members 85 and 86 are each in the form of a semi-circular disk in plan view and are secured to levers 89 and 90 mounted for pivotal motion around shafts 87 and 88, respectively. Gears 91 and 92 are secured to the shafts 87 and 88 for the levers 89 and 90, respectively, and are meshed with each other. An operating lever 93 is also secured to the shaft 87.

The clamp members 85 and 86 each include elastic materials 94 and iron plates 95 layered in alternate relationship and have straight portions 85*a* and 86*a* which are contacted, when the levers 89 and 90 are closed, closely with each other to thus clamp a yarn end Y1 as shown in FIG. 9. Reference numeral 96 designates a circular hole formed in the bottom plate 66, and the circular hole 96 communicates with the cylindrical member 61 of FIG. 3.

Figure 10:
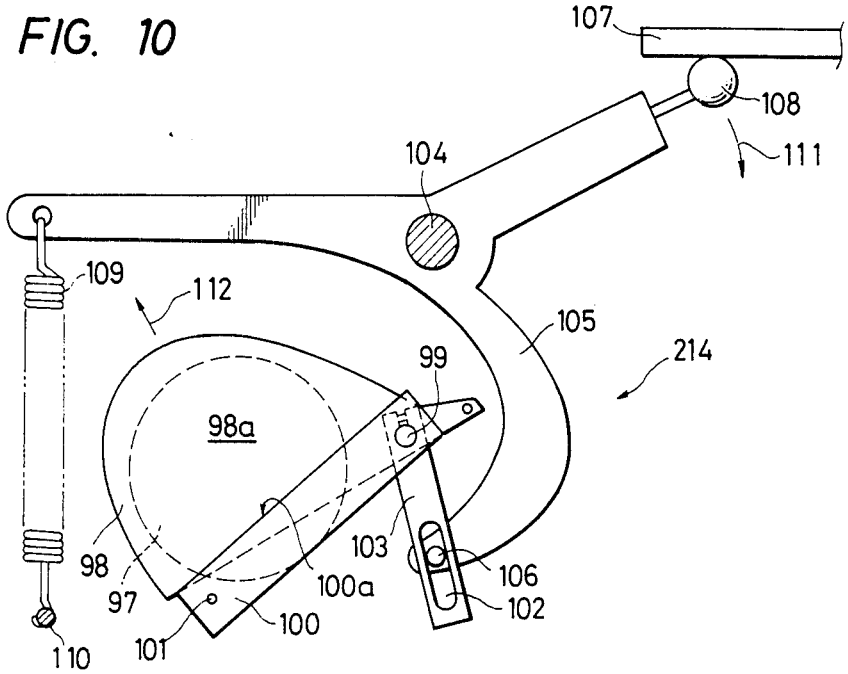
FIG. 10 is a plan view of a yarn end cutting device.
Figure 11:
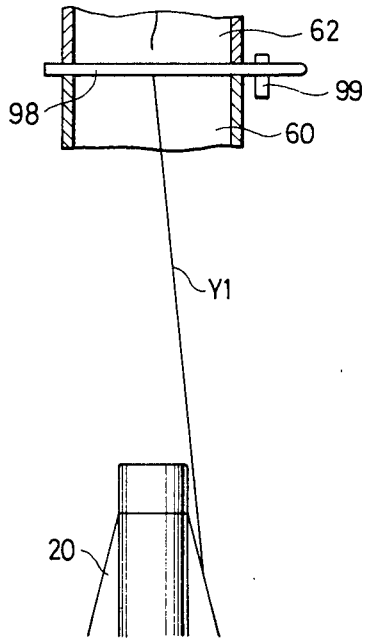
FIG. 11 is a front elevational view showing the yarn end cut.

The yarn cutting device 214 is illustrated in FIGS. 10 and 11. In particular, a movable blade 98 is pivotally mounted at 99 and has an area sufficient to cover an opening 97 at the top end of the second yarn processing chamber 60 while a fixed blade 100 is secured to the bottom plate by means of a shaft 99 and a pin 101 and is positioned such that an edge 100*a* of the fixed blade 100 crosses part of the opening 97. A lever 103 having an elongated hole 102 formed therein is secured to the shaft 99 for the movable blade 98. Fitted in the elongated hole 102 of the lever 103 is a roller 106 provided at an end of an operating lever 105 which is pivotally mounted on a fixed shaft 104. The operating lever 105 has a roller 108 mounted at an end thereof for engagement with an operating plate 107 while a spring 109 extends between the other end of the operating lever 105 and a fixed pin 110.

Accordingly, if the roller 108 is pushed in a direction of an arrow mark 111 by the operating lever 107, the movable blade 98 is moved in a direction of an arrow mark 112 against the urging of the spring thereby to communicate the second processing chamber 60 with the movable pipe above (62 in FIG. 3). As a result, a sucking air flow is produced in the second processing chamber 60 and the first processing chamber 59 and also in the cylindrical member 61 at the bottom end so that the yarn end released from the clamp is sucked into the movable pipe 62. If at this instant the operating plate 107 is moved away from the roller 108, then the movable blade 98 is closed to cut the yarn end while the opening 97 is closed by a flat face 98*a* of the movable blade 98 to thus stop an upwardly directed sucking air flow.

Referring again to FIGS. 4*a*, 4*b* and 5, the second yarn end sucking mechanism 215 is shown. In particular, a suction pipe 113 is disposed below a carrier at the yarn end finding position, and a shutter 115 is supported for pivotal motion at 116 to a position in which it crosses an opening 114 at the top end of the suction pipe 113. One end of the shutter 115 is connected to a rod 118 which is in turn connected to a cam lever 117 such that rotation of a cam plate 119 will temporarily open the shutter 115 at a predetermined point of time to thus cause a suction air flow to be produced in the processing chambers from within a carrier by way of a take-up tube so that a yarn end cut off will be sucked into the take-up tube.

(C) Driving Section of the Yarn End Processing Device

Referring to FIG. 3, the top end of the cam shaft 27 is connected to an output power shaft of a motor 120 while the bottom end thereof is supported uprightly on a bearing 121 on the machine frame. The first cam group 221 provided on the shaft 27 includes, from the bottom, a cam plate 41 for the carrier forcing lever, another cam plate 119 for the shutter, and a further cam plate 53 for the spinning bobbin clamper. The second cam group 222 includes, from the bottom, a top bunch releasing cam plate 122, a cam plate 123 for the yarn end clamp, and a yarn end cutting cam plate 124. The third cam 223 is in the form of a cylinder cam and has a cam face 128 which is contacted by a cam follower 127 pivotally supported on a lever 126 which extends between the vertically movable member 58 and a pivot point 125. Thus, rotation of the cylinder cam 223 will move the vertically movable member 58 up and down.

A lifted highest position of the lever 126 is shown by a two dots and dash line position 126*a*.

Figure 12:
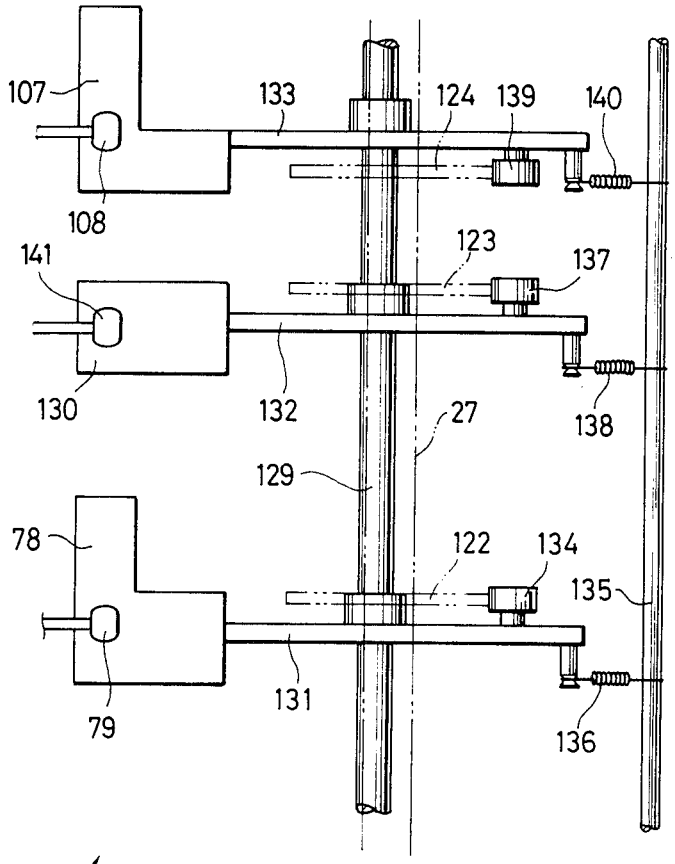
FIG. 12 is a front elevational view illustrating relative positions of cam levers and cam plates of a driving section.
Figure 13:
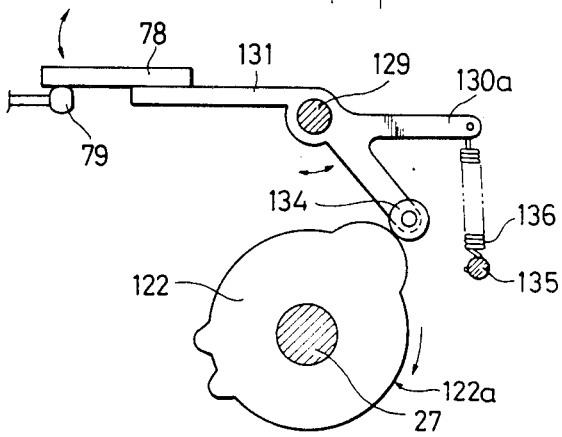
FIG. 13 is a plan view of the cam levers and cam plates of FIG. 12.

A shaft 129 extends in parallel relationship to the cam shaft 27 as shown in FIGS. 12 and 13. At positions on the shaft 129 corresponding to the individual operating elements, cam levers 131, 132 and 133 having operating plates 78, 130 and 107 secured integrally thereto are supported for pivotal motion. And, for example, the cam lever 131 has a cam follower 134 adapted to engage with a cam face 122*a*, and a lever portion 130*a* at which it is connected to a spring 136 which extends to a fixed shaft 135.

The remaining cam levers 132 and 133 have a similar construction.

The apparatus of the invention has such a construction as described so far, and a yarn end finding operation of the apparatus will be described below with reference to a time chart of FIG. 14.

Figure 14:
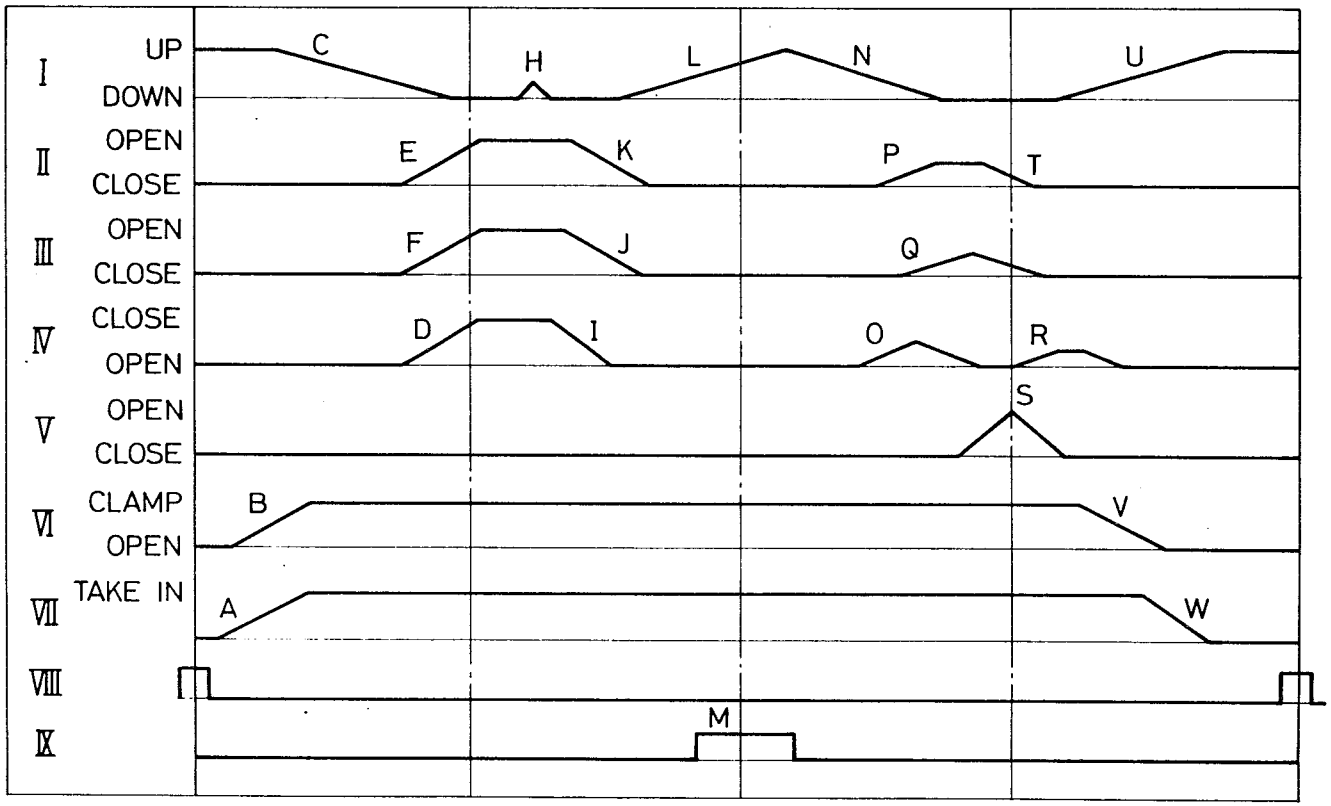
FIG. 14 is a time chart of a yarn end finding process on the apparatus according to the invention.

In FIG. 14, I to IX designate operations of each members, that is, I: vertically movable member; II: yarn end cutting movable blade; III: yarn end clamper; IV: releasing member; V: shutter; VI: spinning cop clamper; VII: carrier take in; VIII: stop of one cycle; and IX: detect of yarn end released from the spinning bobbin.

Referring also to FIG. 1, spinning bobbins on carriers which are fed in a direction of an arrow mark 142 on the spinning bobbin transporting path 7 are stopped once at a position adjacent the yarn end finding apparatus 6 and are taken into the same one by one while fitted on the respective carriers. After completion of yarn end finding operations, the spinning bobbins are discharged from the yarn end finding apparatus 6 and fed to the automatic finder 2.

Referring now to FIG. 4*a* and 4*b*, when, upon discharging of a carrier at the yarn end finding position, the forcing lever 36 returns to the position shown in FIG. 4*a* , the projection 40*b* of the discharging lever 40 is engaged with a second one 19*b* of carriers 19*a*, 19*b* and 19*c* then lying in line on the transporting path 3 so that only the forwardmost carrier 19*a* is allowed to advance to the two dots and dash line position 19*a*l. Then, the forcing lever 36 is pivoted to the position shown in FIG. 4*b*, whereupon the base plate 39 of the carrier 19*a*l is pushed by an end 36*a* of the lever 36 to move along a passage between the side plate 30 and the rockable lever 34*a* while pushing the rockable lever 34*a* to pivot in the counterclockwise direction about the shaft 33 until the carrier is abutted against the spinning bobbin clamping member 46 at the yarn end finding position P1.

At this instant, the discharging lever 40 moves in integral relationship with the forcing lever 36 to the position shown in FIG. 4*b*.

Subsequently, the spinning bobbin clamping member 47 is pivoted from the position of FIG. 4*a* to the position of FIG. 4*b* to thus clamp a lower end portion 20*a* of the spinning bobbin as shown in FIG. 5 (B of FIG. 14).

After completion of the clamping operation, the vertically movable member 58 is lowered (C of FIG. 14) to a position as shown in FIG. 3.

When the vertically movable member 58 comes near the lower limit point of its stroke, the top bunch releasing members 71 and 72 of FIG. 6 are closed (D of FIG. 14) to thus clamp a top bunch Y1 therebetween. Then, the yarn end cutting movable blade 98 is opened (E of FIG. 14) while the yarn end clamping members 85 and 86 are opened (F of FIG. 14) so that a suction air flow acts within the second and first yarn processing chambers 60 and 59 and the cylindrical member 61 around an outer periphery of a layer of a yarn. Accordingly, if there is no top bunch and an end of a yarn sticks to a surface of the layer of the yarn, then it will pass the processing chambers 59 and 60 and come to the movable pipe 62. When there is a top bunch on the spinning bobbin, the releasing members 71 and 72 are closed (D), and in this condition, the vertically movable member 58 is raised a little (H) to draw out a bunch wind from the take-up tube. Thereafter the vertically movable member 58 is lowered again and the releasing members 71 and 72 are opened (I) whereupon the yarn end Y1 which has been drawn out from the take-up tube and is in an entangled condition between the releasing members 71 and 72 are sucked upwardly and pass between the clamping members 85 and 86. Thereupon, the clamping members 85 and 86 are closed (J), the movable blade 98 is closed (K), and the yarn end is released from the layer of the yarn as the vertically movable member 58 is raised (L).

At this instant, the yarn end between the spinning bobbin and the clamping member 85 and 86 is detected (M) by means of a photoelectric sensor (PH1, PH2 of FIG. 3).

If the yarn end of a predetermined length is released from the spinning bobbin, then the vertically movable member 58 resumes lowering movement (N) to enter into a yarn end inserting operation.

In particular, when the vertically movable member 58 comes to a position near the lower end of its stroke, the releasing members 71 and 72 are closed a little (O) and then opened whereafter the movable blade 98 is opened (P) to cause a sucking action to act into the second yarn processing chamber 60. If the clamping members 85 and 86 are opened (Q) in this condition, the yarn end thus released is sucked into the movable pipe 62, passing through the opening (97 of FIG. 10). Further, if the shutter (115 of FIGS. 4*a* and 4*b* of the suction pipe below the carrier is opened and the movable blade 98 is closed (T) while the releasing members 71 and 72 are closed a little (R), the yarn end is cut into a segment having a length of the dimension (l) of FIG. 3 and is sucked into the take-up tube 65.

It is to be noted that if a yarn end is not detected during the yarn end detecting step (M), then the rotary solenoid 54 of FIGS. 4*a* and 4*b* is energized to move the stopper 55 to the two dots and dash line position 55*a* of FIG. 4*b* to prevent a pivotal motion of the discharging lever 40 in the counterclockwise direction while the cam shaft (27 of FIG. 3) makes one complete rotation again to resume another yarn end finding operation. It is further to be noted that if a yarn end is not detected by a predetermined number of yarn end finding operations, the spinning bobbin is discharged as an irregular spinning bobbin as to which yarn end finding is not possible. If yarn end finding has been performed successfully, the vertically movable member 58 is raised (U) while the spinning bobbin clamper 47 is opened (V) as shown in FIG. 14, that is, the clamping member 47 of FIGS. 4*a* and 4*b* returns to the position pf FIG. 4*a*, and as the carrier forcing lever 36 is returned to its initial position (W), the discharging lever 40 pushes the carrier out at the yarn end finding position P1 so that the carrier is discharged onto the transporting path 3, passing between the side plate 31 and the rockable lever 34.

It is to be noted that FIGS. 15, 16, 17 and 18 diagrammatically illustrate the position of the vertically movable member 58 and the condition of an end of a yarn during principal steps of operations shown in the time chart of FIG. 14. In particular, F of FIG. 15 corresponds to the step F of FIG. 14, and FIGS. 16, 17 and 18 correspond to steps L, 7 and S of FIG. 14, respectively.

What is claimed is:

1. A yarn end finding apparatus useable with a spinning bobbin which is located at a fixed position, the bobbin being of the type which comprises a take-up tube erected at one end thereof on a carrier and having yarn wound around the take-up tube, wherein the yarn windings nearest the other end of said tube form a top bunch, the apparatus comprising:

a member mounted for vertical movement along the axial direction of the take-up tube toward and away from the spinning bobbin, the vertically movable member having mounted thereon:

a releasing means for releasing the top bunch, containing the yarn end, from the spinning bobbin;

a suction means for sucking the yarn end thus released vertically away from the bobbin;

a clamping means, disposed above said releasing means, for clamping the yarn which is sucked away from the bobbin;

a cutting means, above said clamping means, for cutting the yarn, which is sucked away from the spinning bobbin, at a predetermined position; and a suction pipe having a first opening located below the carrier at said fixed position for inserting the yarn end thus cut into the take-up tube of the spinning bobbin.

2. A yarn end finding apparatus as claimed in claim 1, wherein:

said vertically movable member defines a first yarn processing chamber having a second opening at the bottom end thereof and a second yarn processing chamber above and in flow communication with the first chamber, the second chamber having a third opening at the top end thereof;

the suction means comprises an extendible pipe having a first end attached to said second chamber at said third opening and a blower, adjacent to the second end of the pipe, for drawing fluid through the first and second chambers, the extendible pipe allowing movement of said vertically movable member; and the cutting means is disposed within the second chamber and, within the first chamber, the clamping means is disposed above the releasing means.

3. A yarn end finding apparatus as claimed in claim 2, further comprising a hollow member having a top and a bottom hole at opposite ends thereof, wherein the hollow member is connected to the lower end of said first chamber so that the hollow member communicates with the first chamber through said top hole and said second opening, the hollow member being adapted to receive, through the bottom hole, most of the length of said bobbin.

4. A yarn end finding apparatus as claimed in claim 2, wherein said releasing means comprises:

a pair of yarn end releasing members, each having an arcuate face adapted to be pressed against the outer periphery of the take-up tube so that said arcuate faces grasp the top bunch; and releasing member moving means for moving the arcuate faces into and out of contact with the take-up tube.

5. A yarn end finding apparatus as claimed in claim 4, wherein each of said yarn end releasing members comprise a plurality of alternating elastic and rigid layers oriented in said releasing members so that the edges of the layers form the arcuate face of each releasing member.

6. A yarn end finding apparatus as claimed in claim 2, wherein said clamping means comprises a pair of clamp members, each having a yarn clamping surface and clamp moving means for moving the clamping surfaces into and out of contact with each other.

7. A yarn end finding apparatus as claimed in claim 2, wherein said cutting means comprises:

a movable blade having a width sufficient to cover said third opening, the movable blade being disposed at the top end of the second yarn processing chamber;

a fixed blade partially covering the third opening; and blade moving means for moving the movable blade across the third opening so that said movable blade abuts the fixed blade and, in conjunction with the fixed blade, closes the third opening.

8. A yarn end finding apparatus as claimed in claim 2, further comprising:

a vertical moving for raising and lowering said vertically movable member at predetermined times during the operation of said apparatus.

9. A yarn end finding apparatus as claimed in claim 8, wherein said vertical moving comprises:

a vertically disposed cam shaft adjacent said movable member having a first cam mounted thereon;

a motor connected to said cam shaft for rotating the shaft;

a lever having a first and a second end, the first end being pivotally connected to said vertically movable member and the second end being pivotable around a fixed point adjacent said cam shaft; and a cam member having one end connected to the lever at a point between the two pivotable ends and the other end of said cam member contacting said first cam to drive the lever as the cam rotates and thereby vertically displace the movable member.

10. A yarn end finding apparatus as claimed in claim 1, further comprising:

a shutter supported for pivotal motion to a position in which it closes the first opening of said suction pipe; and a shutter moving means for moving the shutter between open and closed positions with respect to said first opening.

11. In a yarn end finding apparatus for use in a spinning bobbin supply system of the type that uses bobbins having a take-up tube and yarn wound around the take-up tube, said apparatus including inserting means for inserting the end of the yarn into the hollow center of the take-up tube, the improvement for providing a compact apparatus, comprising:

a hollow member having a first and second opening at opposite ends thereof, said first opening being adapted to receive said bobbin;

means for inserting said bobbin into said hollow member through said first opening so that most of the yarn windings are within said hollow member;

pump means disposed at said second opening for pumping a flow of fluid through the hollow member so that, when said bobbin is inserted in to said hollow member, the fluid flows around the outside of the bobbin along the axial direction of the take-up tube, said flow being directed along most of the length of said bobbin and being sufficiently powerful to draw the end of the yarn away from the bobbin;

a clamp, disposed within said hollow member for clamping the yarn caught in the fluid flow, to thereby prevent excessive unwinding of the yarn, said clamp being disposed at a distance from the bobbin along the axis of the take-up tube in the direction of the flow; and a blade, disposed within said hollow member on the side of the clamp opposite said first opening, for cutting the yarn caught in the fluid flow at a predetermined distance from the clamp.

12. An apparatus as claimed in claim 11, further comprising removing means for removing yarn windings from the end of the take-up tube.

13. An apparatus as claimed in claim 12, wherein said removing means comprises:

a pair of yarn end releasing members disposed within said hollow member on the side of the clamp nearest said first opening, ench member having an arcuate face adapted to grasp yarn windings near the end of the take-up tube when said face is pressed against the periphery of the tube; and releasing member driving means for driving the arcuate faces into contact with the yarn windings near the end of the take-up tube and for moving said releasing members, while said releasing members are grasping the windings, off the end of the take-up tube to release the windings into said flow.

14. In a yarn end finding apparatus of the type usable in a spinning bobbin supply system wherein bobbins having a take-up tube and yarn wound around the take-up tube are transported to a plurality of yarn processing stations, each station being positioned at a different location, the apparatus including a first flow means for directing a first flow of fluid over the yarn to draw the yarn away from the bobbin, a cutting means for cutting the yarn in said first flow at a predetermined distance from the bobbin and a second flow means for directing a second flow of fluid into the hollow core of the take-up tube to draw the end of the remaining length of yarn into the core, the improvement for providing a compact aparatus, comprising:

the colinear arrangement along the axis of said take-up tube, at a single station, of said first flow means, said cutting means and said second flow means, wherein the first flow means is disposed so that said first flow is directed over the yarn windings along the axial direction of the take-up tube, the cutting means is disposed at a predetermined distance from the bobbin in the direction of the first flow and said second flow means is disposed on the opposite side of the bobbin from the cutting means so that the second flow is directed though the hollow core of the take-up tube in the opposite direction from the first flow.

* * * * *